US006992267B2

(12) United States Patent
Wang

(10) Patent No.: US 6,992,267 B2
(45) Date of Patent: Jan. 31, 2006

(54) LOW-TEMPERATURE STEAM ELECTRIC IRON WITH SEPARATELY HEATED STEAM SPACE

(75) Inventor: Donglei Wang, Nanping (CN)

(73) Assignee: Elec-Tech International Co., Ltd., Guangdong Province (CN)

( * ) Notice: Subject to any disclaimer, the term of this patent is extended or adjusted under 35 U.S.C. 154(b) by 0 days.

(21) Appl. No.: 10/267,524

(22) Filed: Oct. 9, 2002

(65) Prior Publication Data

US 2003/0121900 A1 Jul. 3, 2003

(30) Foreign Application Priority Data

Dec. 31, 2001 (CN) ..... 01271598 U

(51) Int. Cl.
*D06F 75/00* (2006.01)

(52) U.S. Cl. ..... 219/251; 219/245; 38/77.83

(58) Field of Classification Search ..... 219/251, 219/252, 255, 245; 38/77.1–77.9, 82
See application file for complete search history.

(56) References Cited

U.S. PATENT DOCUMENTS 4,303,827 A * 12/1981 Kyles ..... 219/512
5,042,179 A * 8/1991 van der Meer ..... 38/77.83
5,279,054 A * 1/1994 Chasen ..... 38/77.7
5,883,358 A * 3/1999 Brandolini et al. ..... 219/258
6,125,562 A * 10/2000 Dodier et al. ..... 38/93
6,263,596 B1 * 7/2001 Pedron et al. ..... 38/77.7
6,363,548 B1 * 4/2002 Kuo ..... 4/622

FOREIGN PATENT DOCUMENTS

| | | |
|---|---|---|
| DE | 4107236 | * 9/1992 |
| FR | 2543180 | * 9/1984 |
| GB | 2217352 | * 10/1989 |
| JP | 2-268800 | * 11/1990 |
| JP | 2001-204998 | * 7/2001 |

* cited by examiner

*Primary Examiner*—John A. Jeffery
(74) *Attorney, Agent, or Firm*—Westman, Champlin & Kelly, P.A.

(57) ABSTRACT

A kind of low-temperature steam electric iron, includes ironing plate, temperature-adjusting plate and temperature adjustable circuit, steam room and its temperature auto-adjusting circuit. A heat insulation layer is positioned between the temperature-adjusting plate and the steam room. A steam passage is formed between the temperature adjusting plate and the ironing plate.

The temperature auto-adjusting circuit in the steam room can immediately sense and adjust the temperature variation in the steam room and make sure that the water in the steam room can be fully evaporated, so the low-temperature fabric material can be ironed.

7 Claims, 3 Drawing Sheets

Figures 2, 5:
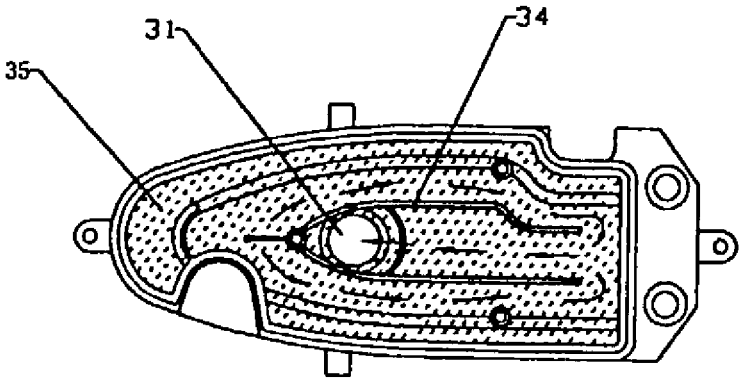

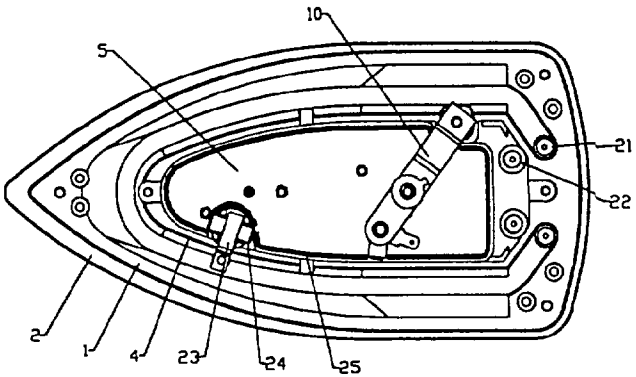
Fig.3
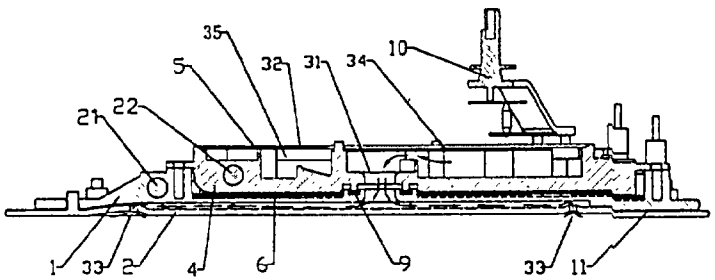
Fig.2
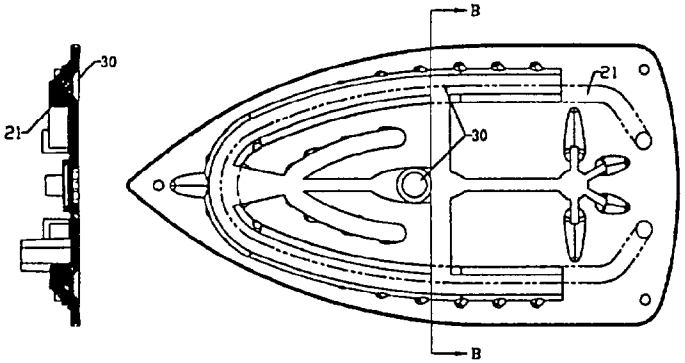
Fig.5
Fig.5-1
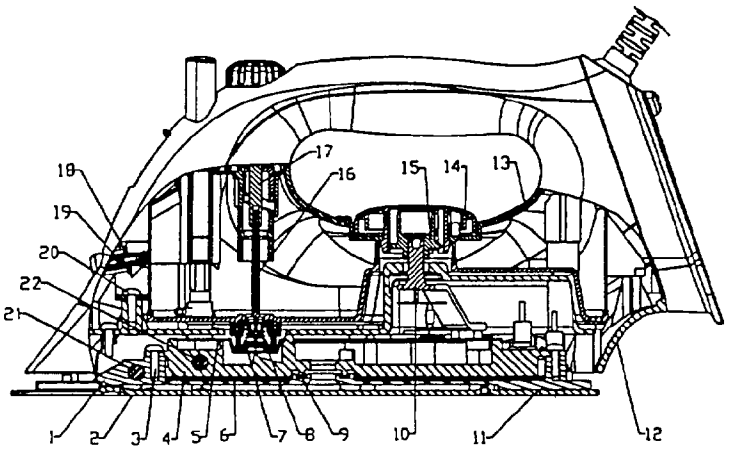
Fig.1

LOW-TEMPERATURE STEAM ELECTRIC IRON WITH SEPARATELY HEATED STEAM SPACE

The present application is based on and claims the benefit of Chinese patent application Serial No. 01271593.0, filed Dec. 31, 2001, the contents of which are hereby incorporated by reference in its entirety.

THE TECHNICAL FIELD

This utility model relates to a kind of steam electric iron used to iron fabric material, especially a kind of low-temperature steam electric iron, which can generate steam at low temperature.

THE BACKGROUND TECHNOLOGY

The conventional steam iron can not generate steam when ironing the fabric materials at low temperature because the temperature at the bottom of iron plate is too low to evaporate the water dropped into the iron evaporating room. If the water in the evaporating room accumulates, it will flow onto the fabric through steam holes. Due to the scale remained in the evaporating room, the water will make the fabric dirty. In order to prevent the water from dropping onto the fabric and making it dirty, some steam irons adopt the water dropping resistance function. When the temperature of the plate is too low, the temperature sensing double metal sheet shall work and make the steam valve closed. This function can prevent the steam valve from being opened by mistake when ironing at low temperature. There are also some preferred steam irons, the double metal sheet, connected with the plate and installed at the steam valve, can control the open and close of the steam valve. When the temperature on the plate is high, the steam volume will increase, and on the contrary, it will decrease, preventing the dropping of water out of the plate. In regard to this method, tinny steam can be produced when at low temperature, but that small amount of steam can not make any effect when ironing. The experiments indicate that the watery steam at low temperature can stretch the fabric with good effects. Therefore, concerning the fabric which needs to be ironed at lower temperature, if it is ironed with the steam, the time of ironing could be reduced and obtain good effects.

THE INVENTIVE CONTENTS

The purpose of this utility model is to provide a kind of low-temperature steam electric iron, which can produce a large amount of watery steam when ironing any fabric material, without worrying about that the dropped water will make the material dirty when ironing at low temperature and the material will be damaged when part of the plate is at higher temperature.

The low-temperature steam electric iron according to this utility model is consisted of ironing plate, temperature adjusting plate and its temperature adjusting circuit, steam space and its temperature auto-control circuit. It is featured that it has independent steam space and temperature auto-control circuit, and there is a heating insulation layer between the temperature adjusting plate and the steam space. The temperature adjusting plate and its temperature adjusting circuit are separated from the steam space and its temperature auto-control circuit.

According to the low-temperature steam electric iron of this utility model, the steam space is installed in the inner-cavity of temperature adjusting plate, and the second sheathed electric heater in the temperature auto-control circuit is press-casting inside the steam space, and inside the steam-processing cavity is "U"-shaped water-stop projecting ridge coated with evaporating coating material, the steam space is covered by a covering plate, which is sealed by high-temperature silicone grease around, the steam is discharged through the round holes in the middle of this room.

According to the low-temperature steam electric iron of this utility model, the ironing plate is fixed to the lower part of the temperature-adjusting plate, the contacting part between these two plates is coated with heat conducting silicone grease, the first sheathed electric heater of the temperature adjusting circuit is press-casting inside the temperature adjusting plate peripherally, the steam passage is below the sheathed electric heater and can communicate with the steam exit of the steam space, the joint between the steam passage and the steam exist is sealed by the sealing ring, and the steam discharging holes are disposed on the bottom of the ironing plate, which is communicated with the steam passage.

According to the low-temperature steam electric iron of this utility model, the temperature-adjusting circuit is consisted of temperature controller, the first heating pipe.

According to the low-temperature steam electric iron of this utility model, the temperature auto-control circuit is consisted of plate-shape temperature auto-controller, the second sheathed electric heater and the electrical resistance, the temperature controller is installed in the front part of the steam space, close to the water inlet of the evaporating cavity, the temperature sensing surface is fixed firmly to the sheathed electric heater and being mounted there by a pressing plate.

According to the low-temperature steam electric iron of this utility model, the temperature auto-control circuit is consisted of temperature sensors, circuit board, the second sheathed electric heater and the electrical resistance, the temperature sensors are fixed in the front part of steam space by a pressing plate, the circuit board is installed inside the hand grip of the electric iron.

According to the low-temperature steam electric iron of this utility model, the heat insulating material between the steam space and the heat adjusting plate is heat preservation cotton or mica cloth.

According to the low-temperature steam electric iron of this utility model, it can iron some low temperature fabrics with steam such as nylon and rayon when the plate is at low temperature, resulting in a better effect and shorter ironing time due to the following reasons:

Because the evaporating room is a separated heating mechanism, the water will not likely to drop out and make the material dirty when the plate is at low temperature.

The low and stable temperature in the evaporating room can produce moisture steam at low temperature, which enables the fabric fiber absorb enough water when ironing, with no worrying about being damaged under high temperature. It can prolong the using time of material.

Because the temperature adjusting plate is separated with the evaporating room, the losing of large amount of heat energy occurred when the temperature adjusting plate is producing steam will not break the temperature balance of plate, preventing the fabric material from damage under high temperature on part of the plate.

THE DESCRIPTION OF THE ATTACHED DRAWINGS

Figure 4:
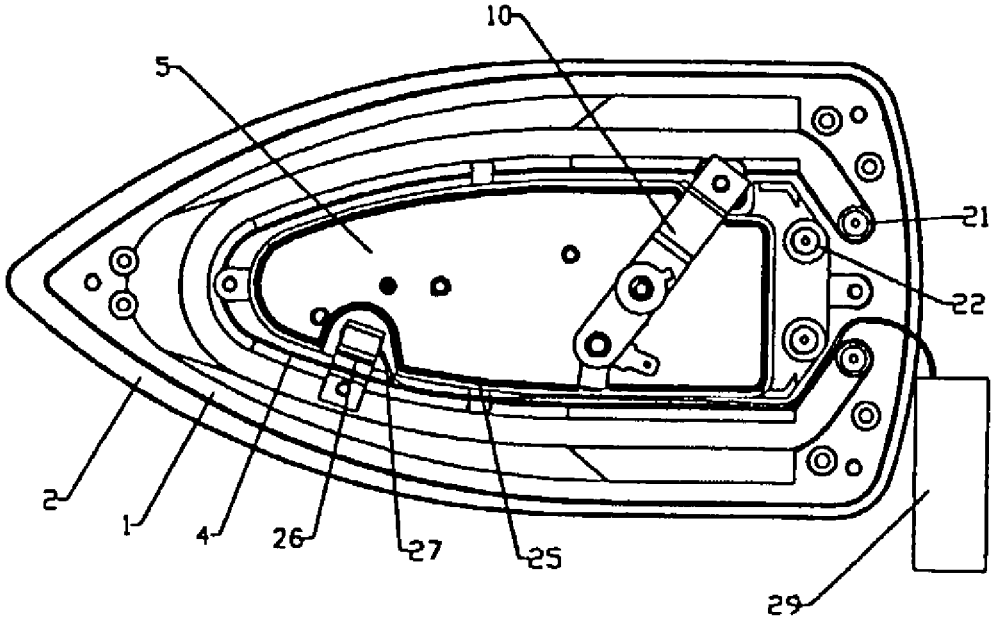
Figure 6:
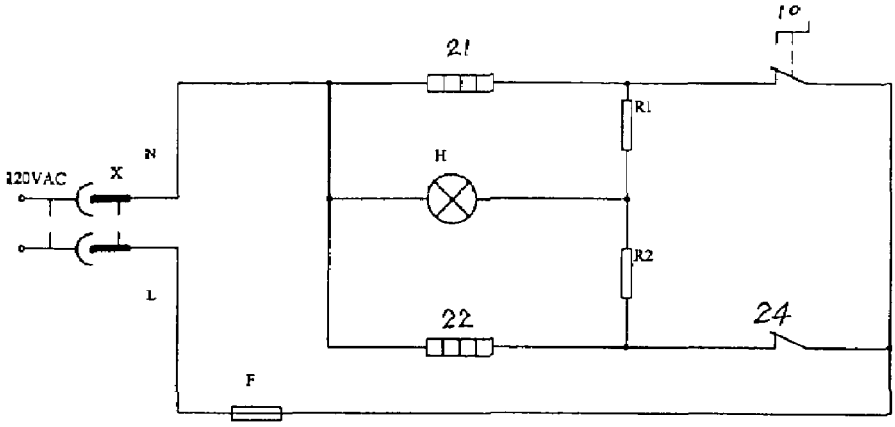
Figure 7:
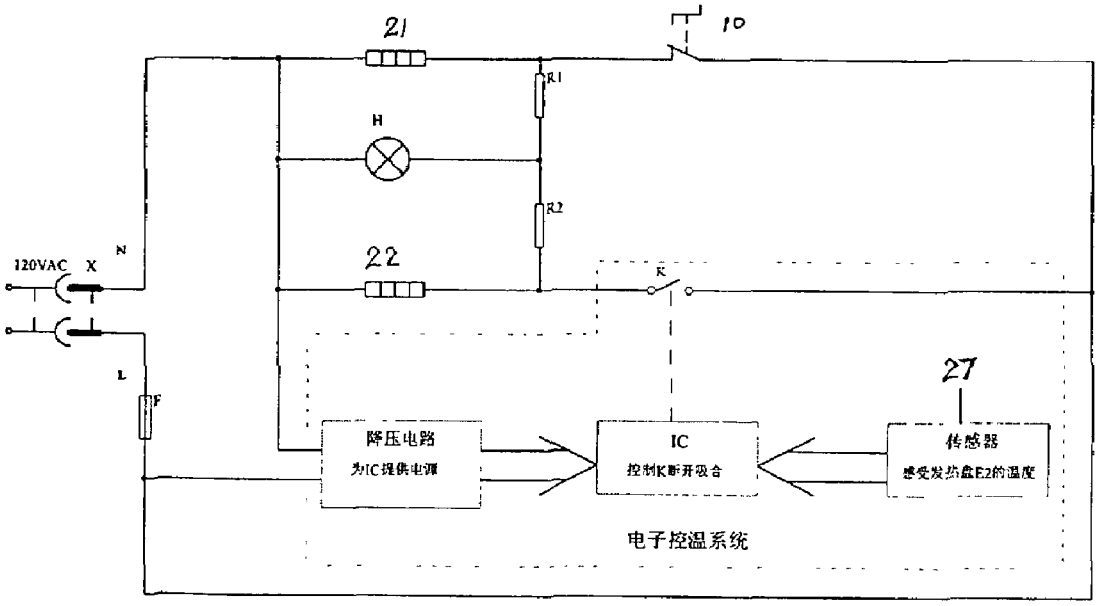

The FIG. 1 is the structural section view of this utility model;

The FIG. 2 is the structural section view of this utility model;

The FIG. 3 is the structural schematic view of embodiment one of this utility model;

The FIG. 4 is the structural schematic view of embodiment two of this utility model;

The FIG. 5 is the schematic view of the steam passage of this utility model;

The FIG. 5-1 is the sectional view along the B—B section of the steam passage of utility model;

The FIG. 5-2 is the structural view of the evaporating cavity of utility model;

The FIG. 6 is the circuit diagram of the embodiment one of this utility model; and The FIG. 7 is the circuit diagram of the embodiment two of this utility model.

1. temperature adjusting plate; 2. ironing plate; 4. steam space; 5. cover plate; 6. heat insulation layer; 9. sealing ring; 10. temperature controller; 11. heat conducting silicone grease; 14. temperature adjusting button; 21. sheathed electrical heater; 22. steam sheathed electrical heater; 23. metal sheet; 24. temperature auto-controller; 25. High temperature silicone grease; 26. press sheet; 32. steam discharge hole; 33. water inlet of evaporating cavity; 34. water-stop projecting ridge; 35. evaporating cavity

THE PREFERRED EMBODIMENTS

Referencing the FIG. 1, the electric iron of this utility model is consisted of ironing plate 2, temperature-adjusting plate 1 and its temperature adjustable circuit, steam space 4 and its temperature auto-adjusting circuit. It is featured that it has independent steam space 4 and temperature auto-control circuit, and there is a heating insulation layer 6 between the temperature adjusting plate 1 and the steam space 4. The temperature adjusting plate 1 and its temperature adjusting circuit are independent from the steam space 4 and its temperature auto-control circuit.

Referring to the FIGS. 2 and 5-2, the steam space 4 is installed in the inner-cavity of temperature adjusting plate 1, and the second sheathed electric heater 22 in the temperature auto-control circuit is press-casting inside the steam space 4, and inside the steam-processing cavity 35 is "U"-shaped water-stop projecting ridge 34 coated with evaporating coating, the steam space 4 is covered by a covering plate 5, which is sealed by high-temperature silicone grease 25 peripherally, the steam is discharged through a round hole 31 in the middle of this room 4.

Referencing the FIGS. 2,5 and FIGS. 5-1, the ironing plate 2 is fixed to the lower part of the temperature-adjusting plate 1, the contacting part between these two plates is coated with heat conducting silicone grease 11, the first sheathed electric heater 21 of the temperature adjusting circuit is press-casting inside the temperature adjusting plate 1 peripherally, the steam passage 30 is below the sheathed electric heater 21 and can communicate with the steam exit 31 of the steam space 4, the joint between the steam passage and the steam exit is sealed by the sealing ring 9, and the steam discharging holes 33 are disposed on the bottom of the ironing plate 2, which is communicated with the steam passage.

The Embodiment One

The temperature auto-controller 24 is installed in the front part of steam space 4, close to water inlet 32 of steam-processing cavity, the temperature sensing face thereof is fixed firmly onto the sheathed electric heater 22 and being secured by a press sheet 26. Referencing to FIG. 6, the temperature adjusting circuit is consisted of temperature controller 10, the first sheathed electric heater 21 and the electrical resistance R1, the temperature auto-controller is consisted of disk-type temperature auto-controller 24, the second sheathed electric heater 22 and the electrical resistance R2. With the power being turned on, the temperature controller 10 is closed when the temperature controller 10 for the first sheathed electric heater 21 has not reached the set temperature; when the temperature auto-controller 24 for the second sheathed electric heater 22 has not reached the set temperature, the temperature auto-controller 24 is also closed, the 120 VAC passes through the first sheathed electric heater 21, display lamp H, electrical resistance (R1, R2), the second sheathed electric heater 22 and the temperature controllers (S1, S2). Both of the sheathed electric heaters (21, 22) are heated, and the display lamp H is lighted. When the temperature controller 10 is at the set temperature, the temperature controller 10 is shut off; when the temperature auto-controller 24 has not reached its controlled temperature, the temperature auto-controller 24 is closed. The 120V AC passes through display lamp H, electric resistance R2, the second sheathed electric heater 22 and temperature auto-controller 24 with the first sheathed electric heater being not heated and the second sheathed electric heater being heated, the display lamp H is lighted. When the temperature auto-controller 24 for the second sheathed electric heater 22 has not reached the predetermined temperature, the auto-controller 24 is shut off; when the temperature controller 10 has not reached its set temperature, the temperature controller 10 is closed, the 120VAC passes through display lamp H, electric resistance R1, the first sheathed electric heater 21 and temperature controller 10 with the sheathed electric heater 21 being heated and the second sheathed electric heater 22 being not heated and the display lamp is lighted. When the temperature controller 10 is at the set temperature, the temperature controller 10 is shut off. When the temperature auto-controller 24 has also reached its set temperature, the temperature auto-controller 24 is also shut off. At that time, there is not current in the circuit passing through the first sheathed electric heater 21, the second sheathed electric heater 22 and the display lamp H. Therefore, both of the sheathed electric heaters (21, 22) are not heated and the display lamp H is not lighted.

The Embodiment Two

Referencing the FIGS. 2 and 4, the temperature sensor 27 is fixed by a press sheet 26 at the same place as the said temperature auto-controller 24. The circuit board 29 is installed inside the hand grip of iron. Referencing the FIG. 7 for circuit diagram, the temperature adjusting circuit is consisted of temperature controller 10, the first sheathed electric heater 21 and electric resistance R1. The temperature auto-control circuit is consisted of temperature sensor 27, circuit board 29, the second sheathed electric heater 22, temperature sensor 27 and electric resistance R2. When the power is turned on, 120V AC is provided to the electrical temperature control system. When sensing that the temperature controller 10 for the first sheathed electric heater 21 has not reached the set temperature, the temperature controller 10 is closed; When the chip IC senses through the sensor 27 that the second sheathed electric heater 22 has not reached the set temperature, the switch K of chip IC is closed, the 120V AC passes through sheathed electric heaters (21, 22), display lamp H, electrical resistance (R1, R2), temperature controller 10, switch K, with the two sheathed electric heaters (21, 22) being heated and the display lamp H is lighted. When the temperature controller 10 has reached its set temperature, the temperature controller 10 is shut off; when the chip IC senses through the sensor 27 that the second sheathed electric heater 22 has not reached the set temperature, the switch K of chip IC is closed, the 120 V AC passes through the second sheathed electric heater 22, display lamp H, electrical resistance R2 and switch K, the first sheathed electric heater 21 is not heated and the second sheathed electric heater 22 is heated and the display lamp H is lighted. When the chip IC senses through the sensor 27 that the second sheathed electric heater 22 has reached the set temperature, the switch K of chip IC is shut off. When the temperature controller 10 has not reached its set temperature, the temperature controller 10 is closed, the 120V AC passes through sheathed electric heater 21, display lamp H, electrical resistance R1, temperature controller 10 and switch K, with the sheathed electric heater 21 being heated, sheathed electric heater 22 being not heated and display lamp H is lighted. When the temperature controller 10 has reached its set temperature, the temperature controller 10 is shut off. When the chip IC senses through the sensor 27 that the second sheathed electric heater 22 has also reached the set temperature, the switch K of chip IC is shut off. At that time, there is no current flowing through the first sheathed electric heater 21, the second sheathed electric heater 22 and the display lamp H, therefore both of the sheathed electric heaters (21, 22) are not heated and the display lamp is not lighted.

The heat preservation cotton or mica cloth could be used as the heat insulating material 6 between the steam space 4 and the temperature adjusting plate 1. When using the electrical iron, the power is turned on, the sheathed electric heater 21 in the plate is heated, the heat will be transferred onto the ironing plate 2 through the heat conducting silicone grease 11. Avoiding a higher temperature on part of the ironing plate 2, the steam passage 30 below the sheathed electric heater 21 can keep a good balance of temperature at every part of the plate 2, preventing the fabric material from being damaged by high temperature at part of the plate 2.

When using the electrical iron, the power is turned on, the heating pipe 21 in the plate is heated, the heat will be transferred onto the ironing plate 2 through the heat conducting silicone grease 11. Avoiding a higher temperature on part of the ironing plate 2, the steam passage 30 below the heating pipe 21 can keep a good balance of temperature at every part of the plate 2, preventing the fabric material from being damaged by high temperature at part of the plate 2.

When water is dropped into the evaporating cavity 35 from its water inlet 35 of the steam space 4, it can be fully evaporated inside the evaporating room due to the U-shaped water-stop projecting ridge 34 installed inside the cavity and being coated with evaporating material, the evaporated steam flows from the exit 31 of steam space 4 into the steam passage 30 at the bottom of the temperature adjusting plate 1, since the heat preservation cotton or mica cloth is disposed between the steam space 4 and the temperature adjusting plate 1, which can prevent the heat conduction between them and the temperature of them shall not be affected by each other. The steam can be discharged from the steam discharging holes 33 of the ironing plate 2 while be used.

The temperature of the steam space 4 can be controlled by the temperature auto-controller 24. Because the disk-shaped temperature auto-controller 24 is fixed to the steam sheathed electric heater 22 firmly, when at working, it can sense immediately the temperature of the steam space 4, thus can keep the power on or off automatically, adjusting the temperature in time.

The temperature of the steam room 4 can also be controlled by the temperature sensor 27, which is fixed closely to the second heating pipe 22 and can monitor the change of temperature in the steam room 4. Because the temperature sensor 27 is more sensitive than the temperature auto-controller 24, it can work more effectively.

The temperature of the steam space 4 can also be controlled by the temperature sensor 27, which is fixed closely to the second sheathed electric heater 22 and can monitor the change of temperature in the steam space 4. Because the temperature sensor 27 is more sensitive than the temperature auto-controller 24, it can work more effectively.

What is claimed is:

1. A kind of low-temperature steam electric iron, comprising:

ironing plate;

a steam space and a temperature auto-control circuit;

a temperature adjusting plate and an adjustable temperature control circuit;

a steam passage;

characterized that:

there is a steam outlet at the middle at the steam space, and a steam outlet is provided at the middle of the temperature adjusting plate; the temperature adjusting plate, the steam space and the ironing plate are constructed to form the steam passage.

2. The low-temperature steam electric iron according to the claim 1, wherein a steam discharge hole is formed at the center of the inner cavity of the steam space, the hole is surrounded by a water-stop projecting ridge in "U" shape and coated with evaporating material.

3. The low-temperature steam electric iron according to the claim 1, wherein the temperature automatic control circuit of the steam space is constructed by dish-shape temperature auto-controller, the second heating pipe and the resistance R2, the dish-shape temperature auto-controller is installed at the front end of the steam space and is adjacent to the water inlet of the evaporating cavity, the set value of the temperature auto-controller could make the water entered into the steam space is evaporated completely, and it is protected when the steam space is dry-heating, the second steam heating pipe is pressed casting into the steam space, a cover plate is provided on the steam space with its peripheral to be sealed by the high temperature silicone grease.

4. The low-temperature steam electric iron according to the claim 1, wherein a steam hole is provided at the center of the temperature adjusting plate, the steam passage is located at the lower end of the heating pipe, the adjustable temperature control circuit is constructed by temperature controller, the first heating pipe and resistance R1, the first heating pipe of the adjustable temperature control circuit is pressed casting into the temperature adjusting plate along the peripheral of the temperature adjusting plate, the temperature of the temperature adjusting plate is adjusted by the temperature controller according to the different ironing material.

5. The low-temperature steam electric iron according to the claim 1, wherein the steam space 4 is at the inner cavity of the temperature adjusting plate, the steam space is fixed to the temperature adjusting plate by a screw, the steam outlet of the steam space is communicated with the steam outlet of the temperature adjusting plate and the interface thereof is sealed by sealing ring the heat insulation layer is provided between the steam space and the temperature adjusting plate.

6. The low-temperature steam electric iron according to the claim 1, wherein the ironing plate is fixed at the lower part of the temperature adjusting plate with heat conducting silicone grease being coated between them, the steam passage is provided at the bottom part of the ironing plate, which is communicated with the steam passage.

7. The low-temperature steam electric iron according to the claim 1, wherein the steam space, temperature adjusting plate and the ironing plate are combined together to construct a complete steam passage, the path of the steam is: through the hole of the steam space, through the hole of the temperature adjusting plate, through the steam passage of the temperature adjusting plate and is discharged through the hole of the ironing plate.

* * * * *